US008708363B1

(12) United States Patent
Chang

(10) Patent No.: US 8,708,363 B1
(45) Date of Patent: Apr. 29, 2014

(54) FOLDING WALKER

(76) Inventor: Joseph Hsiao-Wen Chang, Pompano Beach, FL (US)

( * ) Notice: Subject to any disclaimer, the term of this patent is extended or adjusted under 35 U.S.C. 154(b) by 62 days.

(21) Appl. No.: 13/616,126

(22) Filed: Sep. 14, 2012

(51) Int. Cl.
*A61H 3/04* (2006.01)

(52) U.S. Cl.
USPC ..... 280/642; 280/47.34; 280/647; 135/67

(58) Field of Classification Search
USPC ..... 280/639, 38, 39, 87.021, 87.051, 47.34, 280/642, 647, 649; 135/66, 67, 74
See application file for complete search history.

(56) References Cited

U.S. PATENT DOCUMENTS

D360,174 S * 7/1995 Kjell et al. ..... D12/130
5,605,169 A * 2/1997 Light ..... 135/66
6,318,392 B1 * 11/2001 Chen ..... 135/67
6,378,883 B1 * 4/2002 Epstein ..... 280/250.1
7,052,030 B2 * 5/2006 Serhan ..... 280/304.1
7,540,527 B2 * 6/2009 Willis et al. ..... 280/642

* cited by examiner

*Primary Examiner* — John Walters
(74) *Attorney, Agent, or Firm* — Gold & Rizvi, P.A.; Glenn E. Gold

(57) ABSTRACT

A folding walker includes a first frame of two parallel main supports separated by a horizontal cross bar. An inverted U-shaped second frame has one leg pivotally affixed to each main support of the first frame and pivotal between an extended operable position and a folded storage position. At least one brace extends from an intermediate portion of a leg of the second frame and is pivotally affixed thereto, and an upper end of the brace is slidably attached to an upper portion of one of the main supports of the first frame. At least one tension brace extends between a lower portion of one of the main supports of the first frame and one of the legs of the inverted U-shaped second frame. The tension brace is intermediately hinged wherein a first segment of the tension brace is pivotal with respect to a second segment of the tension brace.

20 Claims, 9 Drawing Sheets

FOLDING WALKER

FIELD OF THE INVENTION

The present disclosure generally relates to a walker for aiding elderly and infirm individual to walk, and more particularly to a foldable walker for aiding people to walk.

BACKGROUND OF THE INVENTION

A walker or walking frame is a tool for disabled or elderly people who need additional support to maintain balance or stability while walking. Walkers started appearing in the early 1950s. The basic design of a walker for adults is a frame approximately waist high, approximately twelve inches deep and slightly wider than the width of a human being. Walkers are also available in other sizes such as pediatric (for children) or bariatric (for obese individuals).

Modem walkers are height adjustable and are typically set at a height that is comfortable for the user while allowing the user to maintain a slight bend in their arms. The bend is needed to permit for proper blood circulation through the user's arms as the walker used. The front two legs of the walker may or may not have wheels attached thereto, depending on the strength and abilities of the person using it. Caster wheels or slides are also commonly seen on the back legs of a walker with wheels on the front.

During use of a walker, the person walks with the frame surrounding their front and sides and their hands provide additional support by holding onto the top of the sides of the walker frame. Traditionally, a walker is picked up and placed a short distance ahead of the user. The user then walks to it and repeats the process. With the use of wheels and glides, the user may push the walker ahead as opposed to picking it up. This make for easier use of the walker, as there is no requirement of the user to use their arms to life the walker. This is beneficial for those with little arm strength. A walker is a good tool for those who are recuperating from leg or back injuries, and is also commonly used by individuals having problems with walking or with mild balance problems.

A related mechanism is commonly referred to as a "rollator," also called a wheeled walker, and was invented in Sweden in 1978 by a polio sufferer. Although originally a brand name. "rollator" has become a genericized trademark for wheeled walkers in many countries, and is also the most common type of walker in several European countries. The rollator has a frame with three or four large wheels, handlebars and a built-in seat, which permits the user to stop and rest when needed. Rollators are also often equipped with a shopping basket. Rollators are typically more sophisticated than conventional walkers with wheels. They are adjustable in height and are light-weight, yet sturdier than conventional walkers. The handlebars are equipped with hand brakes that can be lifted or pushed downward to instantly stop the rollator. The brakes can also be used in maneuvering the rollator by braking one side while turning the rollator towards that side to achieve a much tighter turning radius.

However, walkers such as the rollator and other similar walkers having features such as a seat, additional wheels, and handle grips, while foldable, have much more complicated mechanisms making the folding of the walker difficult and not compact. Therefore, a foldable walker that is simple to fold and compact in its folded state is needed.

SUMMARY OF THE INVENTION

The present disclosure is generally directed to a foldable walker for aiding elderly and disabled individuals to walk that satisfies the need for ease of folding and compactness in its folded form. The foldable walker comprises a first frame including two substantially parallel main supports laterally separated by at least one horizontal cross bar. An inverted U-shaped second frame has two legs, each leg is pivotally affixed to one of the main supports of the first frame, the second frame is pivotal between an extended operable position forming an X-shaped configuration with the first frame and a folded storage position wherein the first frame and the second frame are pivoted one with respect to the other. At least one brace extends from an intermediate portion of a leg of the second frame and is pivotally affixed thereto, and an upper end of the brace is slidably attached to an upper portion of one of the main supports of the first frame. At least one tension brace extends between a lower portion of one of the main supports of the first frame and one of the legs of the inverted U-shaped second frame. The tension brace is intermediately hinged wherein a first segment of the tension brace is pivotal with respect to a second segment of the tension brace.

In another aspect, the first frame includes a hand grip at a top of each main support.

In still another aspect, the hand grip is affixed to an end of an extension tube. The extension tube is telescopically received in the main support and is selectively adjustable along a longitudinal axis.

In yet another aspect, the extension tube includes a plurality of regularly spaced lateral holes therein and the main support includes a lateral hole therethrough. The extension tube is retained in a selected longitudinal relationship with the main support by a keeper engaging the hole in the main support and one of the holes in the extension tube. The holes being in registration one with the other.

In a still further aspect, the keeper includes a resilient C-clip having an internal diameter substantially equal to a diameter of the main support. A pin has a first end embedded in the C-clip and a second end oriented radially toward a center of the diameter. The resilient C-clip engages about a partial circumference of the main support, and the pin engages in the holes in the main support and the extension tube.

In another aspect, the resilient C-clip engages greater than one-half of the circumference of the main support.

In another aspect, the first frame includes an upper horizontal cross bar extending between the main supports at an upper portion of the main supports such that in combination with a base of the U-shaped second frame, the upper horizontal cross bar and the base define a substantially horizontal plane when the second frame is in the extended operable position and the walker is resting on a horizontal surface.

In a still further aspect, a seat extends between the base of the U-shaped second frame and the upper cross bar.

In yet another aspect, the seat is pivotally affixed to the base of the U-shaped second frame and is selectively engagable with the upper cross bar.

In another aspect, the seat includes on a bottom thereof, an engagement clip positioned for retaining the seat to the upper cross bar.

In still another aspect, a flexible cord extends between the seat bottom and the central hinge of the tension brace such that when the seat is disengaged from the cross bar and is rotated about the base of the U-shaped second frame, the flexible cord operates on the tension brace to at least begin folding the tension brace and further folding the second frame with respect to the first frame.

In yet another aspect, a bottom of each main support has a wheel assembly affixed thereto, and the wheel assembly is selectively removable from the main support.

In another aspect, the wheel assembly includes at least one wheel rotatably affixed to a bottom end of a connector tube and an upper end of the connector tube is telescopically received in the bottom of the main support.

In still another aspect, a bottom of each the leg of the second frame has a wheel affixed thereto, wherein the wheel is resiliently mounted to the leg.

In yet another aspect, a foldable walker comprises a first frame including two substantially parallel main supports laterally separated by at least one horizontal upper cross bar. Each main support includes at an upper end thereof a hand grip affixed to an end of an extension tube telescopically received in the main support and retained therein by a keeper. The keeper includes a resilient C-clip having an internal diameter substantially equal to a diameter of the main support and a pin embedded in the C-clip. The pin extends inwardly from the C-clip and engages a hole in the extension tube and a hole in the main support, the holes in registration one with the other. An inverted U-shaped second frame has two legs, each leg is pivotally affixed to one of the main supports of the first frame, the second frame is pivotal between an extended operable position forming an X-shaped configuration with the first frame and a folded storage position wherein the first frame and the second frame are pivoted one with respect to the other. At least one brace extends from an intermediate portion of a leg of the second frame and is pivotally affixed thereto, and an upper end of the brace is slidably attached to an upper portion of one of the main supports of the first frame. At least one tension brace extends between a lower portion of one of the main supports of the first frame and one of the legs of the inverted U-shaped second frame. The tension brace is intermediately hinged wherein a first segment of the tension brace is pivotal with respect to a second segment of the tension brace. A seat extends between the base of the U-shaped second frame and the upper cross bar In a still further aspect, the seat is pivotally affixed to the base of the U-shaped second frame and is selectively engagable with the upper cross bar.

In another aspect, the seat includes on a bottom thereof an engagement clip positioned for retaining the seat to the upper cross bar.

In another aspect, a flexible cord extends between the seat bottom and the central hinge of the tension brace such that when the seat is disengaged from the cross bar and is rotated about the base of the U-shaped second frame, the flexible cord operates on the tension brace to at least begin folding the tension brace and further folding the second frame with respect to the first frame.

In a still further aspect, a bottom of each main support has a wheel assembly affixed thereto, and the wheel assembly is selectively removable from the main support.

In yet another aspect, a bottom of each the leg of the second frame has a wheel resiliently affixed thereto.

These and other features, aspects, and advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, where like numerals denote like elements and in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
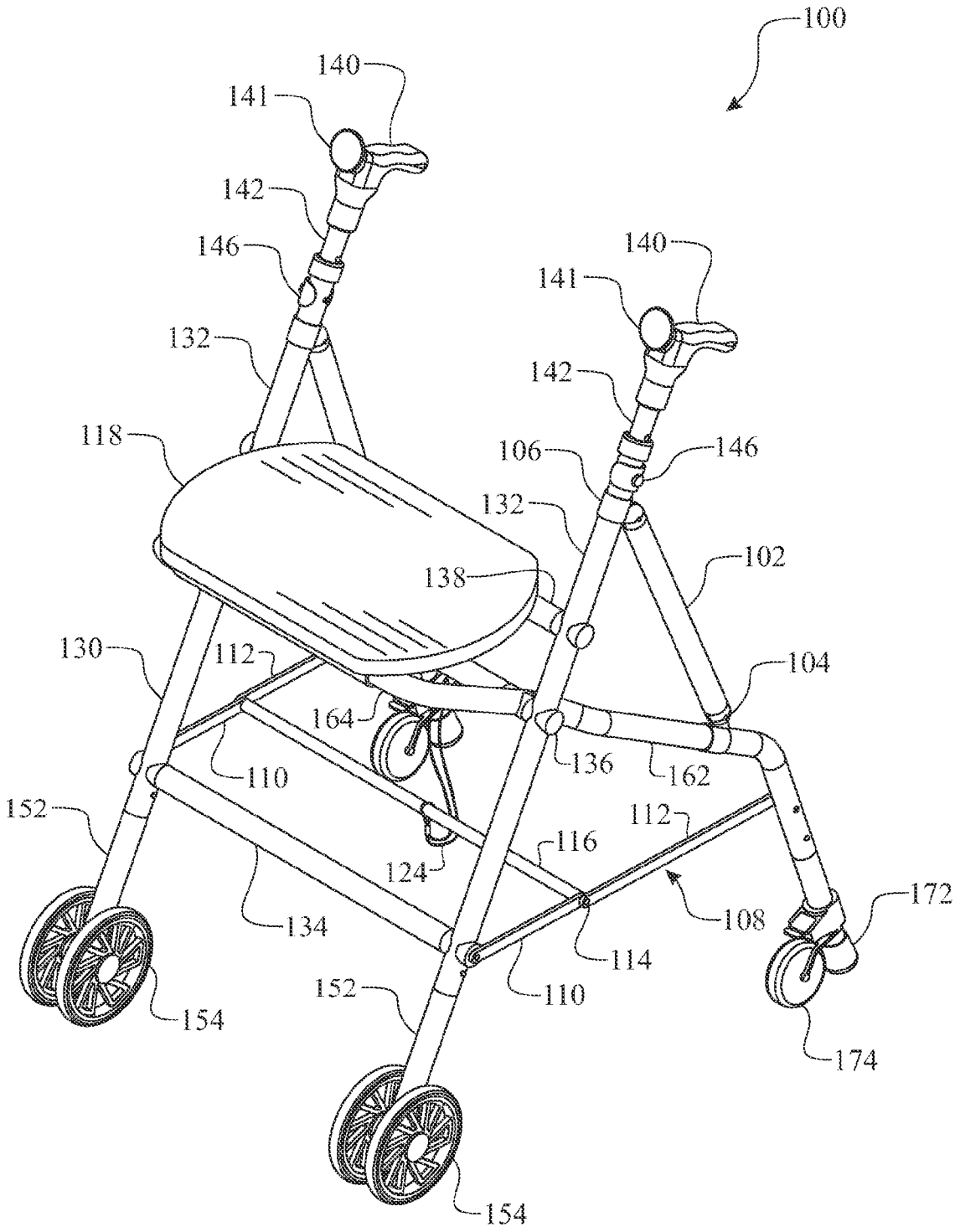
FIG. 1 presents a top front perspective view of a foldable walker embodying the present invention, wherein at least one brace element includes an end thereof slidable with respect to a primary support.
Figure 5:
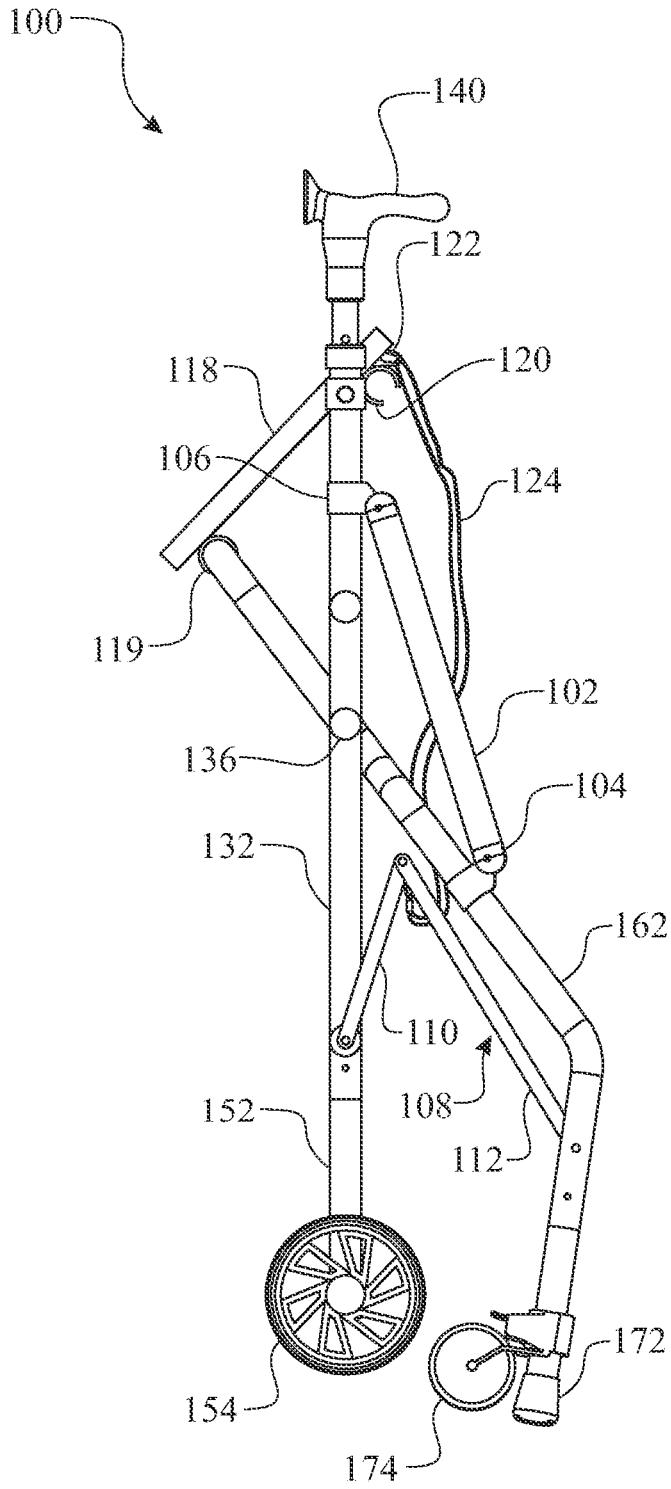
FIG. 5 presents a left side elevation view of the foldable walker in its compact folded state.
Figure 6:
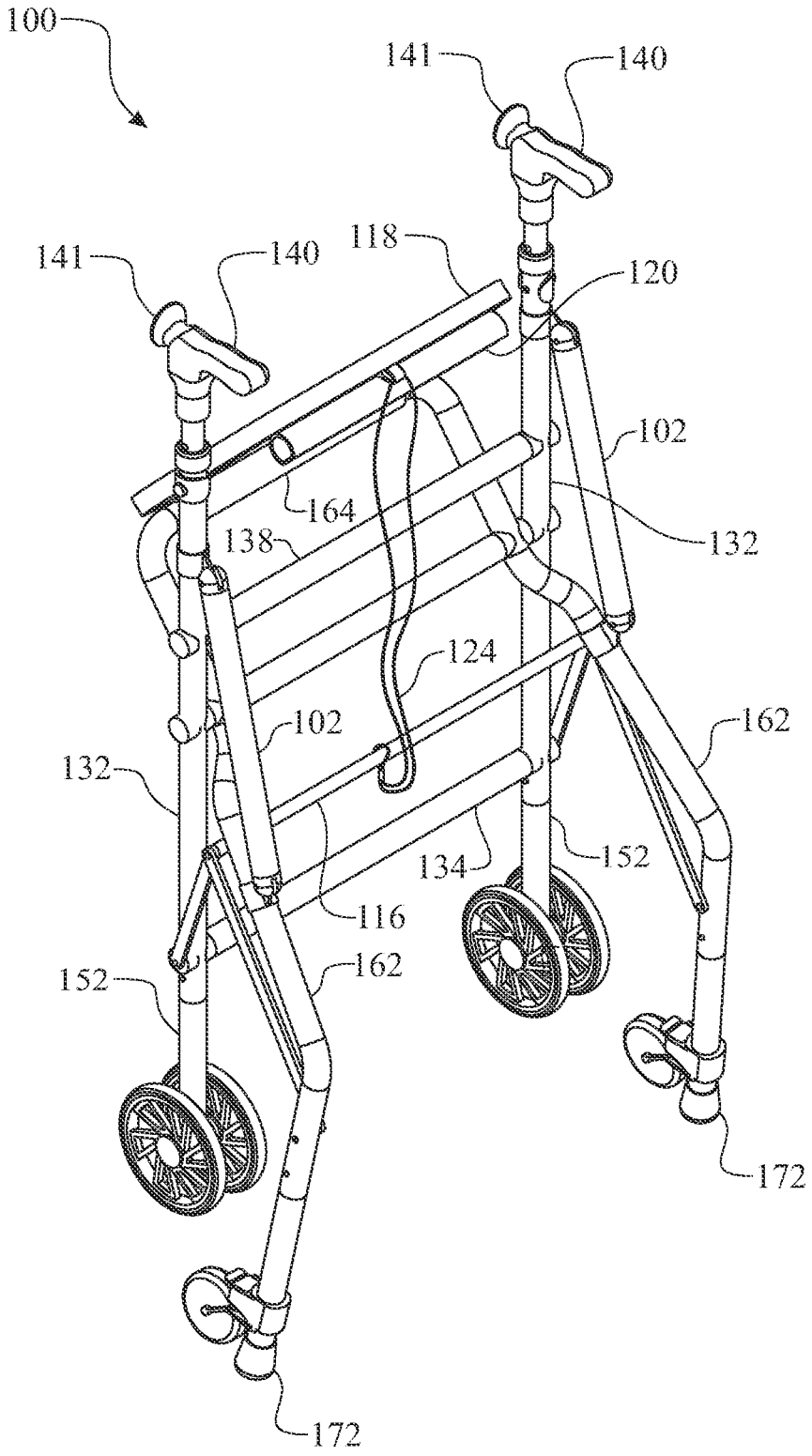
FIG. 6 presents a top rear perspective view of the foldable walker in its compact folded state.

A folding walker 100 for aiding elderly, disabled, and those individuals who have difficulty maintaining their balance to walk is shown in FIGS. 1, 2 and 7-9 and is one of the preferred embodiments of the present invention and illustrates its various components. The construction of the folding walker 100 includes a first frame 130 having two substantially parallel main supports 132 separated by at least one horizontal cross bar 134 and may include additional cross bars such as upper cross bar 138. An inverted U-shaped second frame 160 has two legs 162 separated by a base 164 and each leg 162 is pivotally affixed to one of main supports 132 of first frame 130 at pivot 136 such that first frame 130 and second frame 160 can be pivoted between a collapsed configuration as shown in FIGS. 5-6 and an extended operational configuration as shown in FIG. 1 wherein the first and second frames 130, 160 form an "X". The main supports 132 and the second frame 160 are typically formed of a tubular metal such as aluminum. A brace 102 extends between an intermediate portion of each leg 162 to an upper portion of the main support 132 to which it is pivotally affixed. A lower end of brace 102 is affixed to leg 162 with a pivot attachment 104 to permit brace 102 to pivot with respect to leg 162. An upper end of brace 102 is affixed to an upper end of main support 132 with a slide attachment 106 to permit the upper end of brace 102 to slide along a portion of the length of main support 132 when the folding walker is transitioned between its collapsed configuration and its extended operational configuration.

A tension brace 108 extends between the lower portion of a main support 132 and the leg 162 to which it is pivotally affixed at pivot 136. The tension brace 108 has a first segment 110 and a second segment 108 joined by a pivoting hinge 114 at an intermediate point of tension brace 108. The pivoting hinge 114 permits tension brace to fold and extend when the folding walker 100 is transitioned between its collapsed configuration and its extended operational configuration. Typically, the folding walker 100 will have one tension brace extending between each pivotally coupled main support 132 and leg 162. A connector bar 116 is affixed to and extends between adjacent tension braces 108 at pivoting hinge 114

Figure 7:
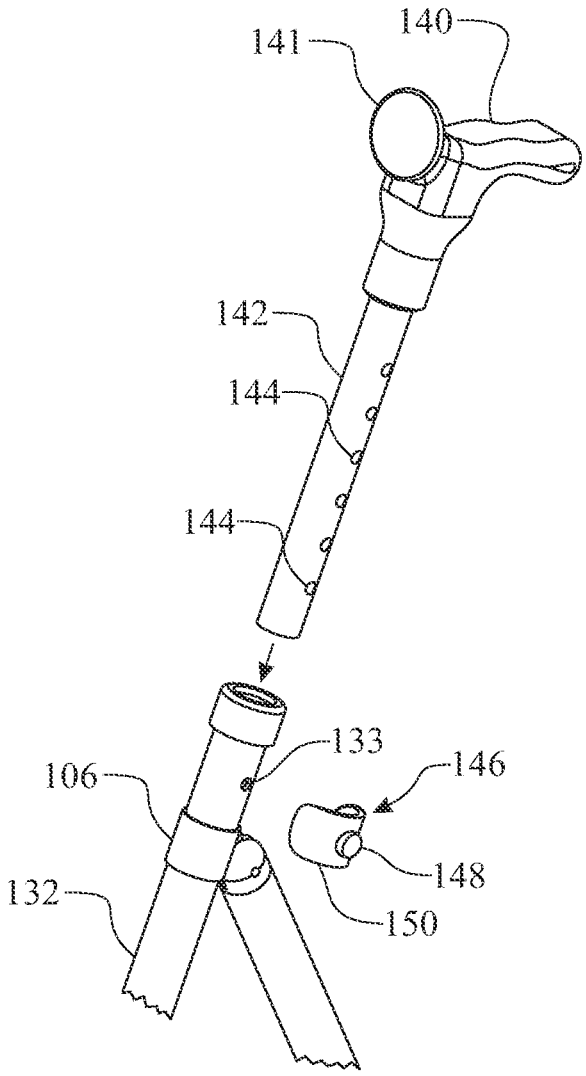
FIG. 7 presents an enlarged front perspective exploded view of the adjustable hand grips.

Each main support 132 includes a hand grip 140, most easily seen in FIG. 7, at an upper end and formed for grasping by an individual using the folding walker 100, and is preferably formed of a molded resin. The hand grip 140 can also include an integrally molded pad 141 which is oriented to function as a point of contact for supporting the folding walker 100 when in its folded configuration and is leaned against a vertical surface. Each hand grip 140 is attached to an upper end of an extension tube 142 wherein the extension tube 142 includes a plurality of lateral holes 144 formed therethrough along an axial length of the extension tube 142. The extension tube 142 is telescopically received in an upper end of the main support 132. The upper end of the main support 132 also includes a lateral hole 133 therethrough. The extension tube 142 is telescoped into the main support 132 so that hand grip 140 is positioned at a comfortable height for the individual using folding walker 100 and wherein one of lateral holes 144 is aligned in registration with the lateral hole 133 in the main support 132. The extension tube 142 is maintained in this relationship by a keeper 146. The keeper 146 is constructed of a molded resinous C-clip 150 which has an interior diametrical curve corresponding to the outer curve of the main support 132. In one embodiment, the C-clip 150 is resilient and extends around greater than one-half of the circumference of the main support 132. A pin 148 has one end embedded in C-clip 150 and extends diametrically to a center of the C-clip 150. The pin 148 engages lateral holes 133 and 144 to retain extension tube 142 in a fixed position with respect to the main support 132. When fully engaged in lateral holes 133, 144, the C-clip 150 extends about the majority of the circumference of the main support 132 for positional retention.

Figure 8:
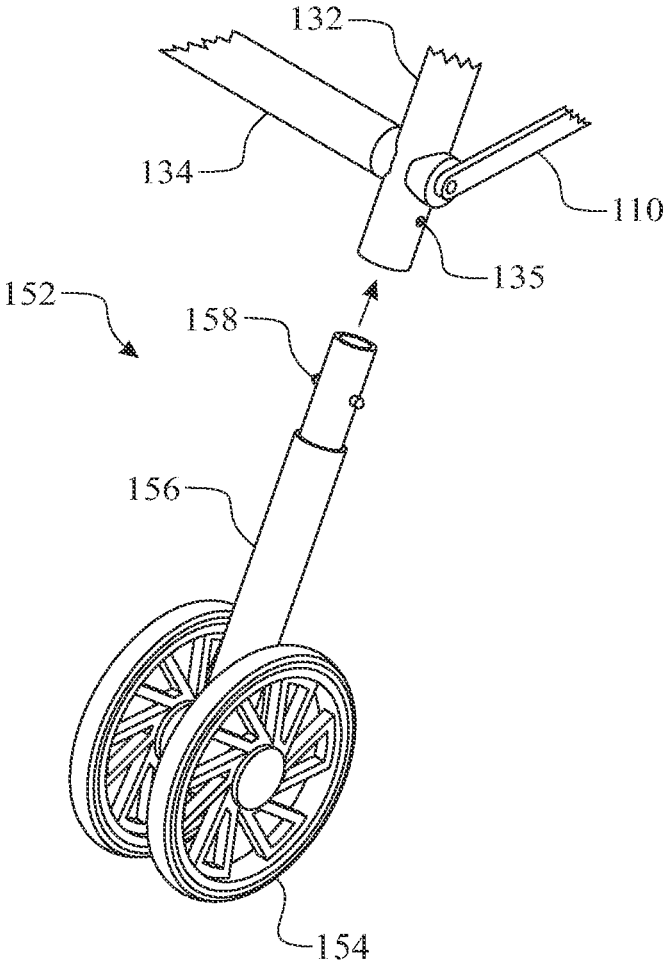
FIG. 8 presents an enlarged front perspective exploded view of the removable front wheel assembly disconnected from a primary support.
Figure 9:
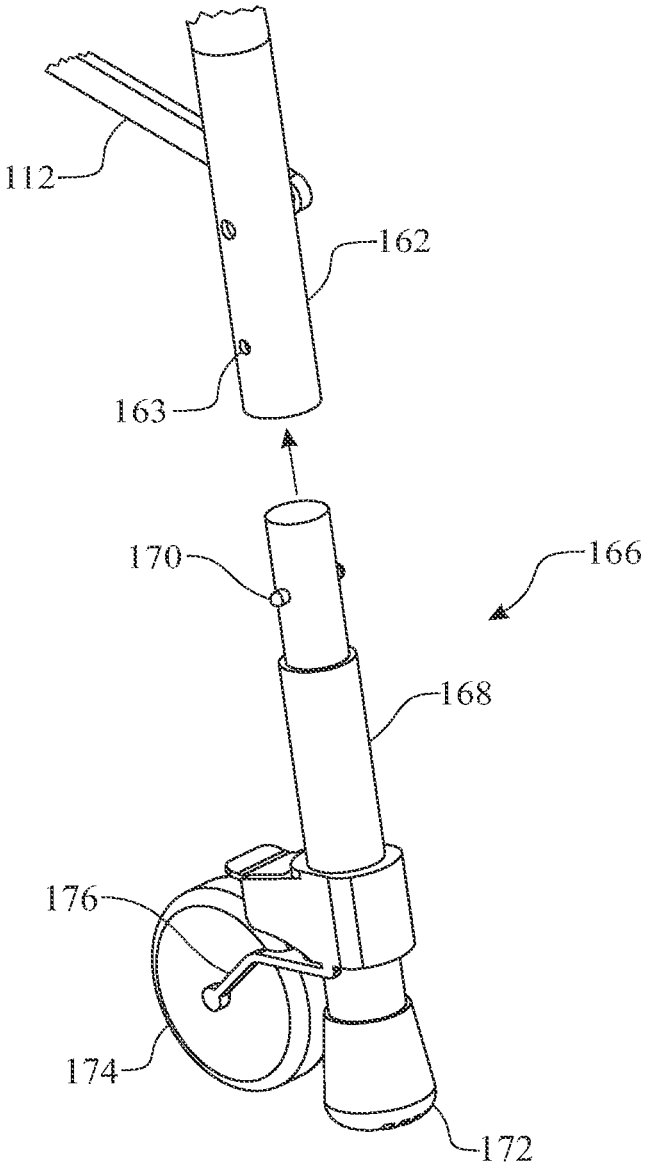
FIG. 9 presents an enlarged rear perspective exploded view of the removable rear wheel assembly disconnected from a secondary support.

A wheel assembly 152, most clearly seen in FIG. 8, is removably affixed to a bottom of each main support 132 to aid the user in moving the folding walker 100 in a forward or rearward direction while the user is walking. The wheel assembly includes a connector tube 156 formed such that an upper end thereof is telescopically received in a bottom of the main support 132. The connector tube can also include one or more spring pins 158 of a known configuration at an upper end thereof for engagement with lateral holes 135 at the bottom of the main support 132. Such engagement securely retains wheel assembly 152 to the bottom of the main support 132. One or more wheels 154 are rotatably affixed to a bottom end of connector tube 156 in a manner to permit wheels 154 to freely rotate.

A foot assembly 166 is removably attached to a bottom of each leg 162 of inverted U-shaped second frame 160. The foot assembly 166 includes a tube 168 formed to be telescopically received into the bottom of leg 162. The tube 168 can also include one or more spring pins 170 of a known configuration at an upper end thereof for engagement with lateral holes 163 in leg 162. Such engagement securely retains foot assembly 166 to the bottom of leg 162. A wheel 174 is attached to a lower end of tube 168 with a resilient support 176. A foot protector 172 is attached to the bottom of tube 168. The foot protector 172 is formed of a non-skid type material such as rubber to prevent the marring of a floor surface on which the folding walker 100 is used and to provide lateral frictional force to prevent the folding walker 100 from slipping. When no downward force is applied to folding walker 100 the wheel 174 supports foot protector 172 above the surface on which the folding walker 100 is used wherein wheel 174 aids the user in moving the folding walker along the surface. However, if a downward force is applied to folding walker 100, the resilience of resilient support 176 is overcome and foot protector 172 contacts the surface on which the folding walker 100 is resting thus providing lateral frictional force to stabilize the folding walker 100 on the surface such as when the user is grasping hand grips 140 and using folding walker 100 for support.

The folding walker can also include a seat 118. The seat 118 is pivotally attached at 119 to base 164 of inverted U-shaped second frame 160. An opposite end of seat 118 includes, on a bottom thereof, an engagement clip 120 for engaging an upper cross bar 138 extending between main supports 132 of first frame 130. The base 164 and the upper cross bar 138 in combination substantially define a horizontal plane when folding walker 100 is resting on a horizontal surface in its operational configuration and when the engagement clip 120 of the seat 118 is engaged on upper cross bar 138, the seat 118 is also substantially horizontally oriented for the convenient seating of the user thereon. The seat 118 also includes proximate to the engagement clip 120, a lug 122 to which a flexible cord 124 is affixed. An opposite end of the cord 124 is affixed to the connector bar 116 extending between pivot hinges 114 of tension braces 108.

Figure 2:
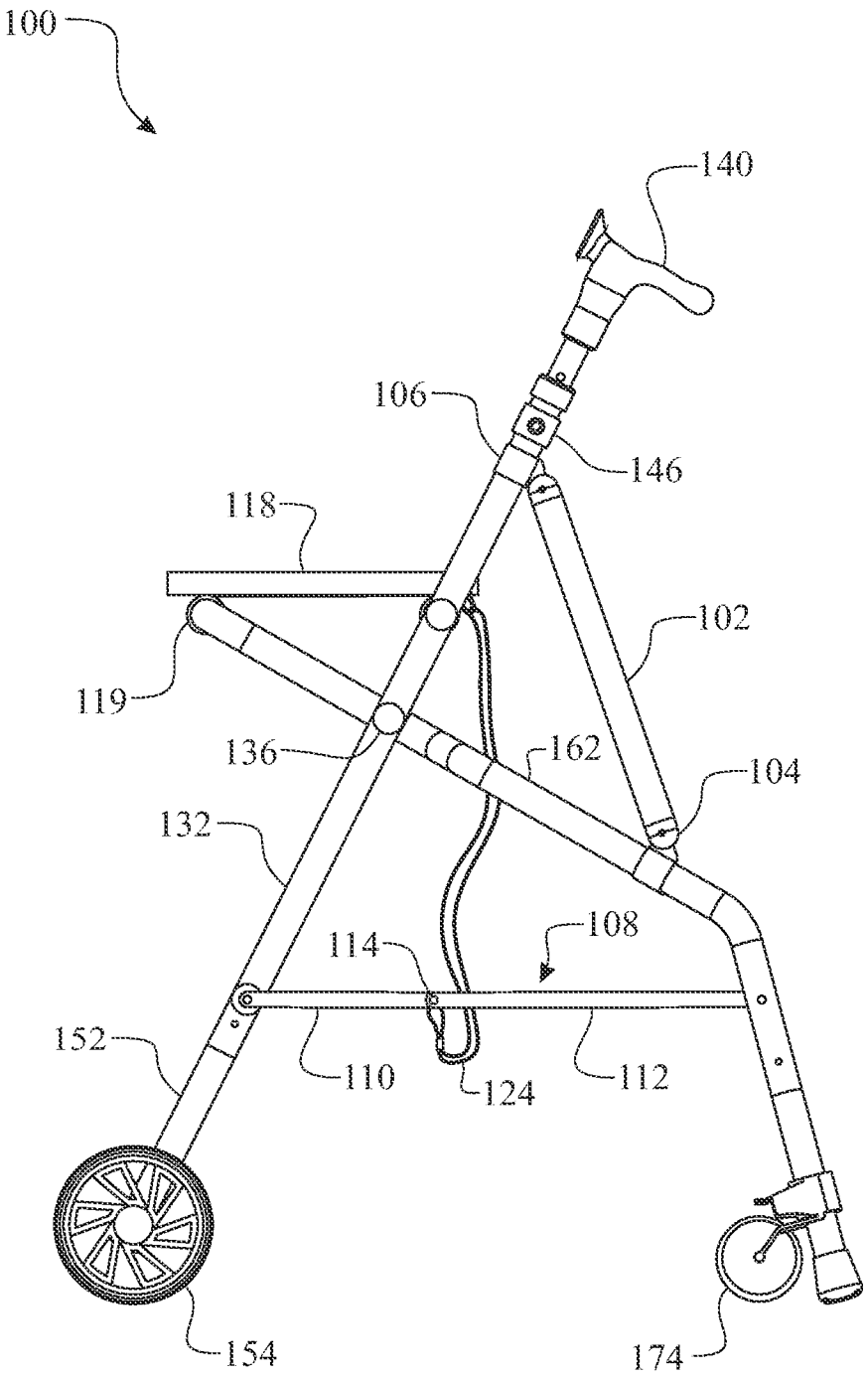
FIG. 2 presents a left side elevation view of the foldable walker.
Figure 3:
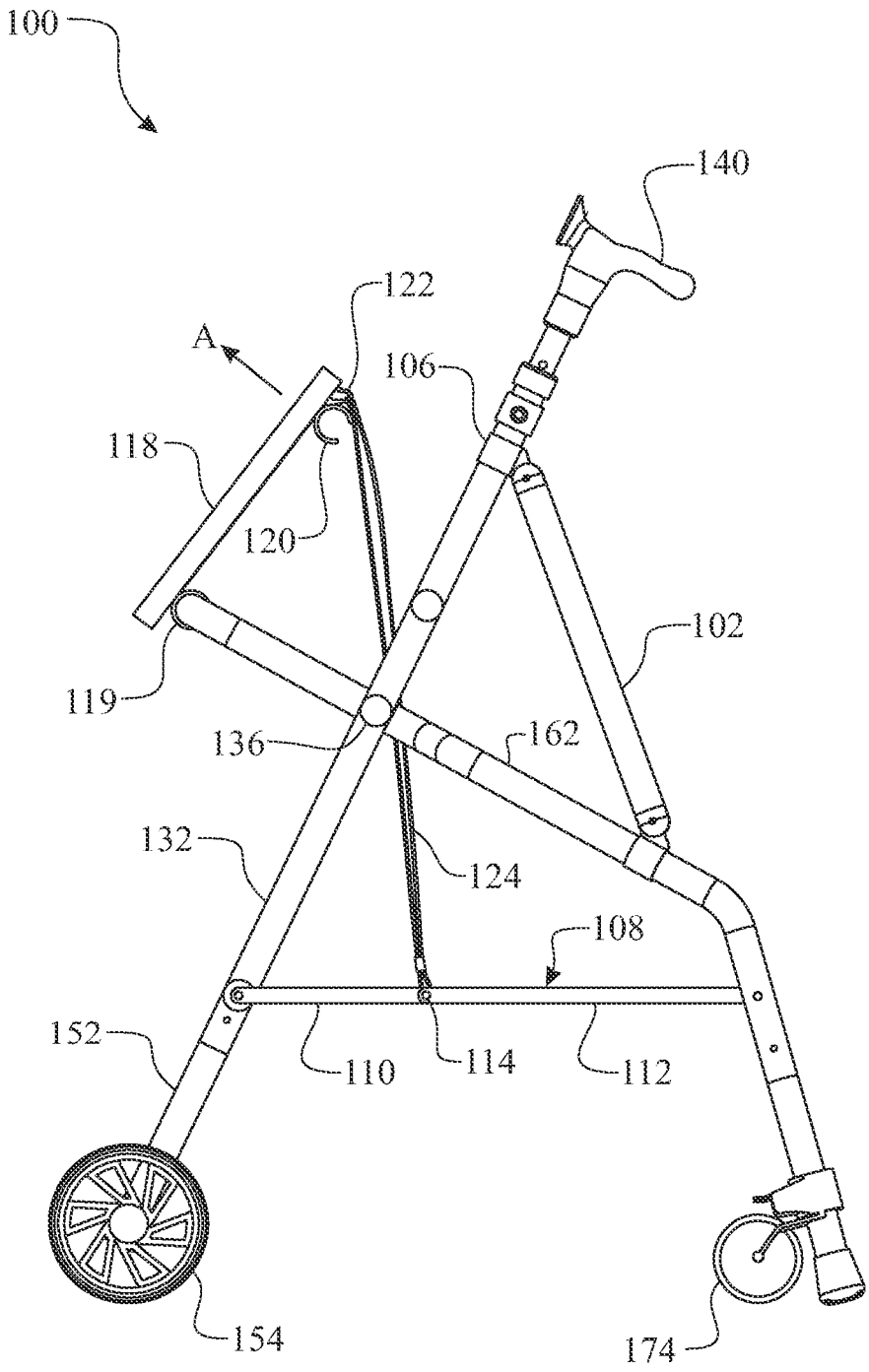
FIG. 3 presents a left side elevation view of the foldable walker in a first stage of folding.
Figure 4:
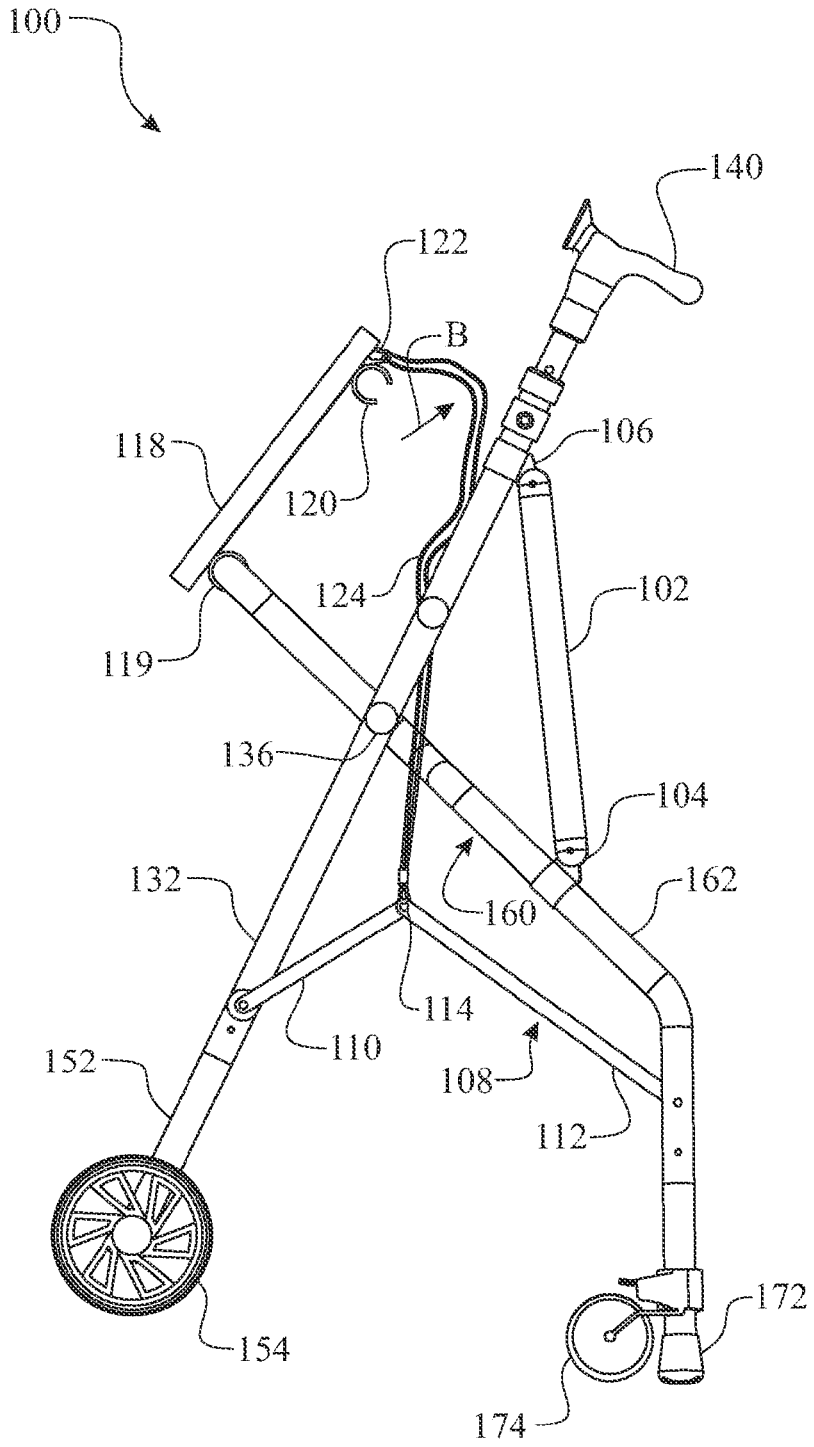
FIG. 4 presents a left side elevation view of the foldable walker in a second stage of folding.

The folding of the folding walker 100 is best illustrated in FIGS. 2-6 wherein the folding walker 100 is shown in FIG. 2 in side elevation view in its extended operational configuration. To fold the folding walker 100 for storage or transport, the rear portion of the seat 118 and engagement clip 120 is disengaged from upper cross bar 138 and pivoted at pivot attachment 119 about base 164 of second frame 160 as illustrated by arrow "A" in FIG. 3 and causing flexible cord 124 to tense against connector bar 116. The upper portion of flexible cord 124 can then be grasped by the user and pulled toward hand grips 140 as illustrated by arrow "B" in FIG. 4. The additional tension applied to flexible cord 124 and transferred to connector bar 116 causes each tension brace 108 to begin folding at pivot hinge 114 thereby initiating the pivoting of first frame 130 with respect to second frame 160. FIGS. 5-6 illustrate the complete pivoting of first and second frames 130, 160 of folding walker 100 into its collapsed configuration. The sliding attachment 106 of brace 102 has translated downwardly on main support 132 during the folding process.

Returning the folding walker 100 to its operational configuration is accomplished by pivoting first and second frames 130, 160 one with respect to the other until tension braces 108 are fully extended and engagement clip 119 is engaged on upper cross bar 138.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A folding walker for aiding elderly and disabled individuals to walk, said folding walker comprising:

a first frame including two substantially parallel main supports laterally separated by at least one horizontal cross bar;

an inverted U-shaped second frame having two legs, each said leg pivotally affixed to one of said main supports of said first frame and pivotal between an extended operable position forming an X-shaped configuration with said first frame and a folded storage position wherein said first frame and said second frame are pivoted one with respect to the other;

at least one brace extending from an intermediate portion of one of said legs of said second frame and pivotally affixed thereto, and an upper end of said brace slidably attached to an upper portion of one of said main supports; and at least one tension brace extending between a lower portion of one of said main supports of said first frame and one of said legs of said inverted U-shaped second frame, said tension brace intermediately hinged wherein a first segment of said tension brace is pivotal with respect to a second segment of said tension brace.

2. A folding walker according to claim 1 wherein said first frame includes a hand grip at a top of each said main support.

3. A folding walker according to claim 2 wherein said hand grip is affixed to an end of an extension tube, said extension tube is telescopically received in said main support and is selectively adjustable along a longitudinal axis.

4. A folding walker according to claim 3 wherein said extension tube includes a plurality of regularly spaced lateral holes therein and said main support includes a lateral hole therethrough, and further wherein said extension tube is retained in a selected longitudinal relationship with said main support by a keeper engaging said hole in said main support and one of said holes in said extension tube in registration therewith.

5. A folding walker according to claim 4 wherein said keeper includes:

a resilient C-clip having an internal diameter substantially equal to a diameter of said main support;

a pin having a first end embedded in said C-clip and a second end oriented radially toward a center of said diameter: wherein:

said resilient C-clip engages about a partial circumference of said main support, and said pin engages in said holes in said main support and said extension tube.

6. A folding walker according to claim 5 wherein said resilient C-clip engages about greater than one-half of said circumference of said main support.

7. A folding walker according to claim 6 wherein said first frame includes an upper horizontal cross bar extending between said main supports at an upper portion of said main supports such that in combination with a base of said U-shaped second frame, said upper horizontal cross bar and said base define a substantially horizontal plane when said second frame is in said extended operable position and said walker is resting on a horizontal surface.

8. A folding walker according to claim 7 further including a seat extending between said base of said U-shaped second frame and said upper cross bar.

9. A folding walker according to claim 8 wherein said seat is pivotally affixed to said base of said U-shaped second frame and selectively engagable with said upper cross bar.

10. A folding walker according to claim 9 wherein said seat includes on a bottom thereof, an engagement clip positioned for retaining said seat to said upper cross bar.

11. A folding walker according to claim 10 further including a flexible cord extending between said seat bottom and said central hinge of said tension brace such that when said seat is disengaged from said cross bar and is rotated about said base of said U-shaped second frame, said flexible cord operates on said tension brace to at least begin folding said tension brace and further folding said second frame with respect to said first frame.

12. A folding walker according to claim 1 wherein a bottom of each said main support has a wheel assembly affixed thereto, and further wherein said wheel assembly is selectively removable from said main support.

13. A folding walker according to claim 12 wherein said wheel assembly includes at least one wheel rotatably affixed to a bottom end of a connector tube and an upper end of said connector tube is telescopically received in said bottom of said main support.

14. A folding walker according to claim 13 wherein a bottom of each said leg of said second frame has a wheel affixed thereto, said wheel resiliently mounted to said leg.

15. A folding walker for aiding elderly and disabled individuals to walk, said folding walker comprising:

a first frame including two substantially parallel main supports laterally separated by at least one upper horizontal cross bar, each said main support including at an upper end thereof a hand grip affixed to an end of an extension tube telescopically received in said main support and retained therein by a keeper, said keeper comprising a resilient C-clip having an internal diameter substantially equal to a diameter of said main support and a pin embedded in said C-clip, said pin extending inwardly from said C-clip and engaging a hole in said extension tube and a hole in said main support, said holes in registration one with the other:

an inverted U-shaped second frame having two legs interconnected by a substantially horizontal base, each said leg pivotally affixed to one of said main supports of said first frame and pivotal between an extended operable position forming an X-shaped configuration with said first frame and a folded storage position wherein said first frame and said second frame are pivoted one with respect to the other, at least one brace extending from an intermediate portion of one of said legs of said second frame and pivotally affixed thereto, and an upper end of said brace slidably attached to an upper portion of one of said main supports;

at least one tension brace extending between a lower portion of one of said main supports of said first frame and one of said legs of said inverted U-shaped second frame, said tension brace centrally hinged wherein a first segment of said tension brace is pivotal with respect to a second segment of said tension brace; and a seat extending between said base of said U-shaped second frame and said upper cross bar.

16. A folding walker according to claim 15 wherein said seat is pivotally affixed to said base of said U-shaped second frame and selectively engagable with said upper cross bar.

17. A folding walker according to claim 16 wherein said seat includes on a bottom thereof, an engagement clip positioned for retaining said seat to said upper cross bar.

18. A folding walker according to claim 17 further including a flexible cord extending between said seat bottom and said central hinge of said tension brace such that when said seat is disengaged from said cross bar and is rotated about said base of said U-shaped second frame, said flexible cord operates on said tension brace to at least begin folding said tension brace and further folding said second frame with respect to said first frame.

19. A folding walker according to claim 18 wherein a bottom of each said main support has a wheel assembly affixed thereto, and further wherein said wheel assembly is selectively removable from said main support.

20. A folding walker according to claim 19 wherein a bottom of each said leg of said second frame has a wheel affixed thereto, said wheel resiliently mounted to said leg.

* * * * *